United States Patent [19]

Keller

[11] 4,366,682

[45] Jan. 4, 1983

[54] APPARATUS FOR THE CONTINUOUS TREATMENT OF TEXTILE MATERIALS

[75] Inventor: Walter Keller, Willich, Fed. Rep. of Germany

[73] Assignee: Eduard Küsters, Krefeld, Fed. Rep. of Germany

[21] Appl. No.: 173,339

[22] Filed: Jul. 29, 1980

[30] Foreign Application Priority Data

Mar. 15, 1980 [DE] Fed. Rep. of Germany ..... 3010038

[51] Int. Cl.[3] ..... D06B 1/06

[52] U.S. Cl. ..... 68/200; 118/412; 118/413

[58] Field of Search ..... 118/407, 410, 413, 126, 118/261, 412; 68/200

[56] References Cited

U.S. PATENT DOCUMENTS

| | | | |
|---|---|---|---|
| 1,956,561 | 5/1934 | Coates | 118/126 |
| 2,328,183 | 8/1943 | Barrett | 118/413 |
| 2,439,802 | 4/1948 | Frances, Jr. | 118/407 X |
| 3,050,829 | 8/1962 | Appenzeller | 29/113 AD |
| 3,070,066 | 12/1962 | Faeber | 118/413 |
| 3,192,895 | 7/1965 | Galer | 118/413 X |
| 4,158,076 | 6/1979 | Wallsten | 118/410 X |
| 4,193,762 | 3/1980 | Namboodri | 68/200 X |

FOREIGN PATENT DOCUMENTS

| | | | |
|---|---|---|---|
| 2416259 | 10/1975 | Fed. Rep. of Germany | 68/200 |

*Primary Examiner*—John P. McIntosh
*Attorney, Agent, or Firm*—Kenyon & Kenyon

[57] ABSTRACT

An improved apparatus for the continuous treatment of webs of materials such as textile materials with a foamed treatment medium. The apparatus includes a rotating cylinder, the length of which is at least equal to the width of material being treated and the circumference of which engages the web over a portion of the cylinder. The web is looped over the cylinder in a looping region and the apparatus further includes a foam feeding device which transfers foam to the web in a transfer region at the circumference of the cylinder. The improvement of the invention comprises a foam feeding means which includes a foam chamber disposed adjacent the cylinder at the looping region, the looping region being located at a side of the cylinder which descends during rotation of the cylinder. The foam chamber opens adjacent the web at the looping region and a wiper is disposed at the lower end of the foam chamber parallel to the longitudinal axis of the cylinder.

13 Claims, 6 Drawing Figures

APPARATUS FOR THE CONTINUOUS TREATMENT OF TEXTILE MATERIALS

BACKGROUND OF THE INVENTION

1. Field of the Invention

The present invention relates to an improved apparatus for the continuous treatment of webs of textiles and similar materials with a foamed treatment medium.

2. Description of the Prior Art

Methods for the continuous treatment of webs of textile or paper material with a foamed treatment medium are known in the art. See, for example, German Offenlegungsschrift No. 27 22 082. In a method disclosed in this publication, foam is applied directly on a substrate by means of a nozzle. Although it is possible to satisfactorily apply relatively large quantities of a liquid in foam form to a web of material in this manner, such a method is not suitable for the application of small amounts of liquid due to unavoidable variations in the amount of liquid applied by the nozzle on a given surface area of the web, and also local variations in the absorptivity of the web, which cause considerable relative differences in the coverage of the web. This results, when dyeing, in distinctly visible differences in the depth of the color. Also, subsequent wiping or squeezing-off of the foam, as is described in U.S. Pat. No. 2,719,806 for producing coatings, does not provide, according to past experience, sufficient uniformity of application in dyeing operations.

U.S. Pat. No. 2,795,207 discloses a coating apparatus in which a pair of spaced-apart cylinders are disposed parallel to each other at the same height and are adjustable with respect to each other. A web of material is conducted over one cylinder, through the gap between the cylinders, and around the lower part of the second cylinder. In the upper corner between the two cylinders, a foam feeding device dispenses foam into the gap between the two cylinders, so that it makes contact on the one hand with the surface of the second cylinder and on the other hand with the side of the web of material facing the cylinder. The foam is applied at approximately the height of the point at which the web of material is transferred from the first to the second cylinder. The layer of foam remains between the web of material and the second cylinder and is separated from the second cylinder after having travelled through a looping angle of about 180° with the web of material.

The foregoing apparatus is intended to be used for the production of foam rubber coatings on a web of material, where the coating is to be preserved as a layer having its own thickness. Small variations in the feeding of the foam are of no interest in processes effected using this apparatus because they are mechanically compensated for by the subsequent travel around the second cylinder. If such an apparatus were used for dyeing, however, unavoidable local variations in the foam feeding would result in a different coverage of the surface of the web of material with the dyeing liquid, which leads to a non-uniform depth of color. This is particularly so since the foam is applied directly to the web of material and is immediately absorbed by the latter. A non-uniform amount of the dyeing liquid, once absorbed by the web of material by the capillarity between the fibers, or by partial coating of the fibers, cannot be equalized later, contrary to the case of a coating which can be further equalized mechanically and remains as a layer, but should not penetrate into the web of material.

A special problem in the treatment of webs of material of the foregoing type is the uniform application of small amounts of the treatment medium, i.e., the application of just the required amount of treatment medium without the need for dissolving the latter in a large amount of water and to impregnate the web of material therewith, and without having to work with an excessive amount of treatment medium.

SUMMARY OF THE INVENTION

It is therefore an object of the present invention to overcome the aforementioned disadvantages of heretofore known apparatus and to provide an improved apparatus for continuous treatment of webs of material with a foamed treatment medium which enables uniform application of the treatment medium in quantities per unit of the surface area to which the treatment medium is applied which are small.

These and other objects of the invention are achieved in an apparatus for the continuous treatment of webs of materials such as textile materials with a foamed treatment medium. The apparatus includes a rotating cylinder, the length of which is at least equal to the width of the web of material being treated and a portion of the surface of which engages the web of material. The web of material is looped over the cylinder in a looping region, and the apparatus further comprises a foam feeding means for transferring foam to the web of material in a transfer region located at the circumference of the cylinder. The improvement comprises the foam feeding means including a foam chamber disposed adjacent the cylinder at the looping region, the looping region being located on a side of the cylinder which descends during rotation of the cylinder. The chamber opens adjacent the web of material at the looping region, and wiper means are disposed at a lower end of the foam chamber and extends parallel to the longitudinal axis of the cylinder.

The web of material on the cylinder moves past the foam chamber and forms the one boundary thereof, so that the foam contained in the foam chamber is in contact with the web of material during the passage of a given surface area of the web of material through the foam chamber. The foam, thus, has a certain amount of time to superficially join the web of material. At the exit of the foam chamber, the foam is transported away by the web of material and is wiped off by the wiper to a desired layer height which then remains on the web of material. This layer height can be adjusted depending on the desired amount of application. The wiper may also rest directly on the web of material, so that the layer height of foam is not noticeably detectable on the web after it has passed the wiper, and the foam is pushed slightly into the web of material by the wiper.

It has been found that the uniformity of application using the apparatus of the invention is surprisingly high with very small quantities of application. Using the apparatus of the invention, it is possible, for example, to dye a thin cotton fabric uniformly on one side without the dye showing through on the other side.

For very small application quantities, the conditions at the wiper are particularly critical because small absolute differences in the application per unit of area result in considerable relative differences. The distance of the wiper from the circumference of the cylinder or the web of material lying on it is approximately one millimeter or less. The foam is transported by the web from the foam chamber and is pulled under the wiper, expanding to a somewhat larger layer thickness behind the wiper. Distance differences of a few tenths of a millimeter can cause considerable relative differences in the specific amounts of the treatment medium applied in a width zone of the web. However, to maintain a small distance on the order of one millimeter with an accuracy of one-tenth of a millimeter or less for a web width of several millimeters requires special measures.

In addition to a device for adjusting the radial distance of the wiper from the circumference of the cylinder, a device for adjusting the radial distance of the wiper from the circumference of the cylinder differently over the length of the wiper is provided, in order to equalize possible inaccuracies and particularly to enable deliberate application of different quantities of the treatment medium. The deflection of the wiper is also controllable in order to accomplish this different setting and to enable, if required, compensation for the unavoidable sag inherent in a structural part as long and slim as a wiper.

The surface of the wiper is preferably convex in shape so that the foam is, so to speak, driven into a wedge-shaped gap when passing the wiper, and is compressed there. Such a wiper design not only evens out the foam surface but also homogenizes the foam by the pressure exerted. If the convex surface is continuously curved in a forward direction in the region located behind the narrowest point (in the direction of rotation of the cylinder), the foam can be stopped or transported away at the surface of the wiper which recedes from the surface of the web, whereby the foam is separated from the wiper at different points. This can cause a noticeable non-uniformity of application. In order to suppress this effect, a break-away edge is preferably provided which provides a breaking point with an accurately defined position.

The web of material which arrives on the cylinder from the top in the foam chamber tends to cause a depression, due to the take-along effect, in the foam contained in the foam chamber on the side adjacent to the cylinder, and possibly even drag along or inject air into the foam, which can lead to local non-uniformity of the foam. To suppress this phenomenon, a cover is provided for the foam which covers the top of the latter and prevents air from being taken along when the cylinder and the web of material rotate.

These and other novel features and advantages of the present invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
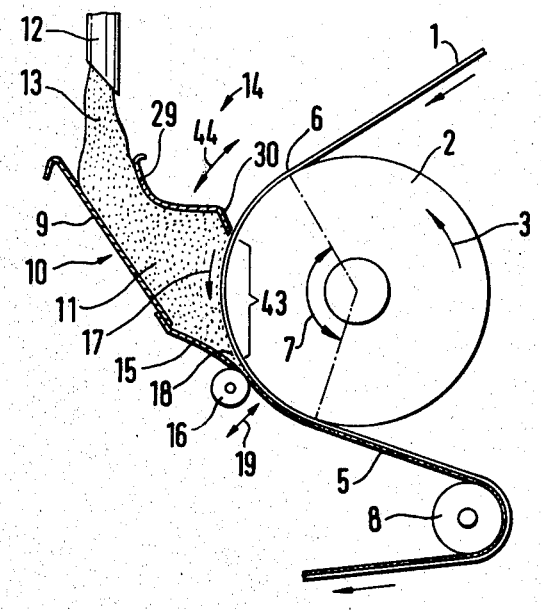
FIG. 1 is a schematic illustration of one embodiment of an improved apparatus for the continuous treatment of webs of materials constructed according to the present invention.

Referring now to the drawings, and in particular to FIG. 1, there is shown a treatment apparatus 10 including a cylinder 2 extending over the width of the web of material 1. The cylinder has a smooth closed surface which revolves in the direction of arrow 3. The web of material 1 moves from a point 6, which is located on the side of the cylinder which descends during rotation in the upper quadrants thereof, onto the cylinder 2 and is looped around cylinder 2 through a looping angle 7. In the illustrated embodiment of the invention, the looping angle is approximately 120° to 150°. The web 1 is guided away from cylinder 2 by a guide roll 8.

On the descending side of cylinder 2, i.e., on the left side of FIG. 1, a foam chamber 11, which extends over the length of cylinder 2 and into which foam 13 is fed through a foam feeding pipe 12, is formed by a plate 9 which is disposed at an angle against cylinder 2 and approaches the latter at its lower end. The entire assembly forms a foam feeding device 14. The lower edge of plate 9 includes a lip 15 which rests on top of a wiper 16, which comprises a tube extending parallel to the axis of cylinder 2 and is slightly spaced-apart from the circumference of the cylinder and from web of material 1.

The foam 13 in foam chamber 11 is transported along in the transfer region 43 by the rotation of cylinder 2 in the direction of arrow 3, or by the web of material 1 on cylinder 2 as indicated by arrow 17. After passing through the lower opening 18 of the foam chamber 11, the foam is guided between web of material 1 and wiper 16 and subsequently forms on web 1 either a thin, homogenized foam layer 5, or an unnoticeable layer which has been worked into web 1 by wiper 16.

The foam chamber 11 is funnel-shaped in cross-section and opens toward the bottom of the chamber. The chamber has no undercuts of any kind so that there are no dead corners in which foam could remain for an extended period of time and possibly collapse. The entire quantity of foam which is applied is immediately transported away as it is fed into the chamber and is drawn-off from lower opening 18 of foam chamber 11 or under wiper 16.

A cover 29 is disposed over foam 13 in foam chamber 11 and is formed by a piece of sheet metal which extends over the width of the web. The cover is shaped in the manner illustrated in FIG. 1 and is held in position by suitable guides (not shown), for example, guide rods. The cover can be moved in a circular arc 44 about the axis of cylinder 2 so that the distance of the inner edge of cover 29 from the circumference of cylinder 2 or the web of material 1 remains constant. This distance is small but always is sufficient to assure that web 1 does not touch cover 29 when cylinder 2 rotates.

Cover 29 covers the foam near cylinder 2 so that web 1, when it revolves around cylinder 2 and passes through foam chamber 11, cannot generate a depression in the foam by taking the latter along with it in the direction of arrow 17 and, in particular, cannot inject air into foam 13. In order to enhance this effect as strongly as possible, cover 29 has an angled portion 30 on its side facing cylinder 2 which is oriented in the direction of motion of web 1, i.e., in the direction of arrow 17. A depression which would otherwise be formed in the foam is thus prevented from causing air occlusions.

Cover 29 is utilized for controlling the filling level in foam chamber 11. This is accomplished by moving cover 29 in circular arc 34. The transfer region 43 in which web 1 is in contact with foam 13 in foam chamber 11 is determined by the filling level. The extent of transfer region 43 determines the time during which web 1 and the foam are joined in foam chamber 11. The pressure which the foam exerts on the web of material and which also determines its penetration into the latter, is also varied at the same time by changing the filling level. The extent of transfer region 43 and, thus, the contact time must in general be changed with the travel velocity of web 1. Generally speaking, the higher the travel velocity, the wider transfer region 43 must be so that sufficient contact time is obtained.

In the embodiment of the invention illustrated in FIG. 1, cover 29 has a substantially S-shaped cross-section due to angled portion 30 and an arch at its opposite side. It is to be understood, however, that a tray-like cover or a cover member of similar external shape can also be used instead of the illustrated sheet metal structure.

Figure 2:
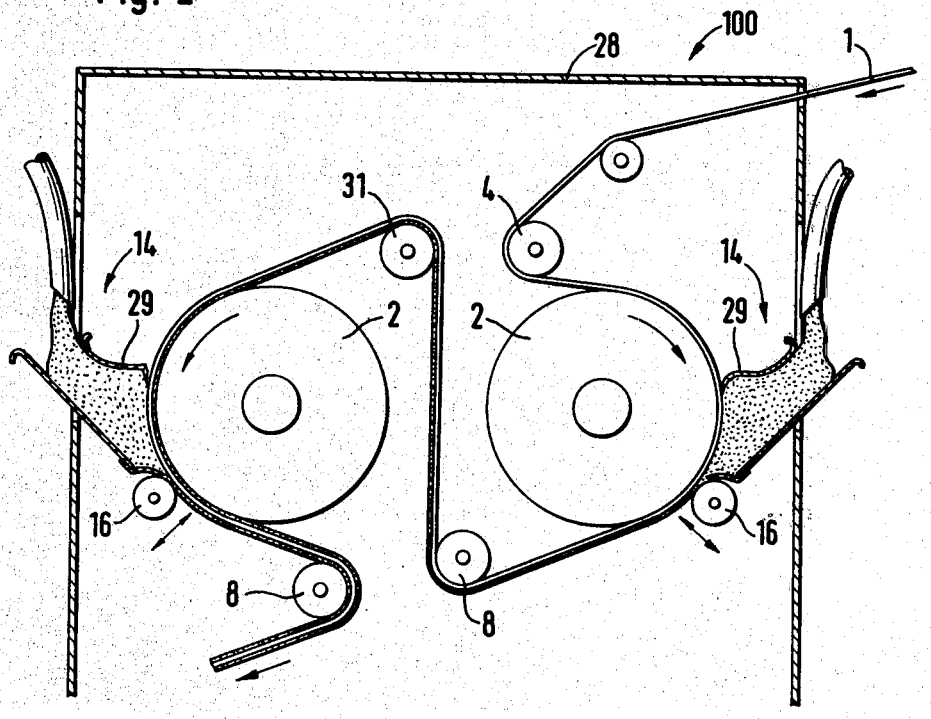
FIG. 2 is a schematic illustration of another embodiment of an improved apparatus constructed according to the present invention which is used for applying a foamed treatment medium on both sides of a web of material.

FIG. 2 illustrates another embodiment of the invention in which the dyeing apparatus 100 consists of two of the apparatus 10 illustrated in FIG. 1 and sequentially apply a foamed treatment medium to both sides of web 1. Cylinders 2 of the apparatus 10 are disposed parallel to each other at about the same vertical height and are spaced apart. The web 1 passes into housing 28 of apparatus 100 at its top and is then guided downwardly over a guide roll 4 located above the first of the cylinders 2. The web is looped over the cylinder and a guide roll 8 located beneath cylinder 2, and is guided between cylinders 2 without making contact with either by means of a guide roll 31 disposed above the second of cylinders 2. The web passes over a guide roll 8 located beneath the second cylinder, and is removed from the apparatus 100 under the second cylinder. Foam feeding devices 14 are located at the respective outer sides of housing 28 for easy accessibility.

Figure 3:
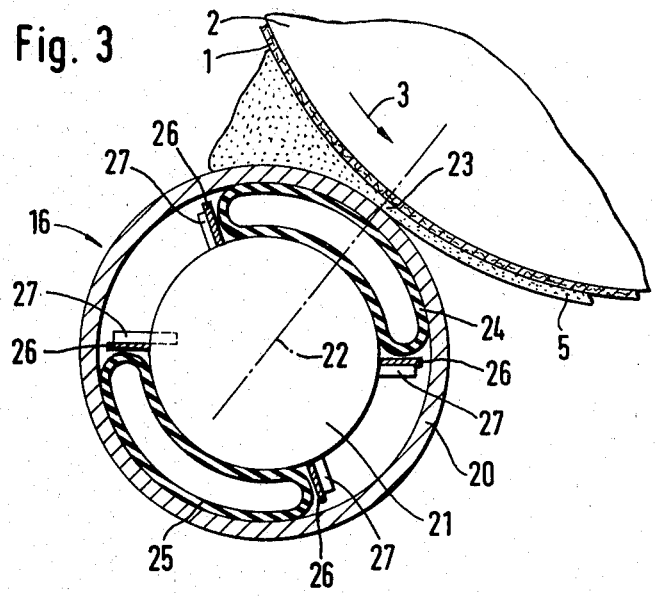
FIG. 3 is an enlarged, cross-sectional view of one embodiment of a wiper for use in an improved apparatus constructed according to the present invention.

FIG. 3 illustrates the wiper, which consists of an outer non-rotatable tube 20 which extends along the length of cylinder 2 and surrounds a stationary core 21. Tube 20 is supported on core 21 in bearings disposed at the ends of the tube and is spaced apart from the inner surface of the core. The core consists of bar material and is movably supported at its ends protruding from tube 20 with respect to cylinder 2 in a radial direction indicated by arrow 19 (FIG. 1) so that the position of wiper 16 can be adjusted with respect to the outer surface of cylinder 2.

In the position adjustment plane indicated by the line 22, flattened tubes 24 and 25 are disposed within tube 20 adjacent the gap 23 between cylinder 2 and wiper 16 as well as on the opposite side of the tube. Each of the tubes 24 and 25 extends substantially over the entire length of tube 20, is closed at its ends and can be filled under controlled conditions with a fluid pressure medium, for example, air. Flexible tubes 24 and 25 are held in position by strips 26 which are supported by pins 27 in core 21.

Pressure in gap 23 causes a bending moment to be exerted on tube 20 with the result that tube 20 is displaced at its center in a direction away from the surface of cylinder 2, which makes gap 23 and the amount of foam transferred to cylinder 2 non-uniform. In order to counteract this deflection, pressure is generated in tube 24 which counteracts the bending of tube 20 from the inside. Tube 24 is braced against core 21, which is bendable downwardly and to the left in FIG. 3 under the action of the pressure, without the deflection being transmitted to tube 20. The pressure in flexible tubing 25 is preferably low or reduced to a level of zero. It is, of course, also possible to intentionally make gap 23 uneven by bending tube 20 forward against cylinder 2 by generating a high pressure in tube 24, or by forcing tube 20 away from cylinder 2 at its center by causing predominant pressure to exist in tube 25.

The foam 13 is transferred from lower opening 18 of foam chamber 11 into gap 23, which can be exactly defined geometrically. Cylinder 2 and, thus, also web 1 looped around it, represent a precise support for foam 13, which must pass through the narrowest point of gap 23 and can be wiped off in the process to a desired uniform thickness. The foam is at the same time also homogenized by compression when it enters funnel-shaped gap 23. The evened layer 5 of the foamed treatment medium is transported away by web 1.

It is possible to completely and uniformly dye one side of white cotton goods with a pink hue using the apparatus of the invention without any noticeable penetration of the color to the other side of the goods. A foam with a high foam number, i.e., a large volume ratio between the foam and the liquid producing it, is preferably used, for example, a foam number in the range of 15 to 20.

Figure 4:
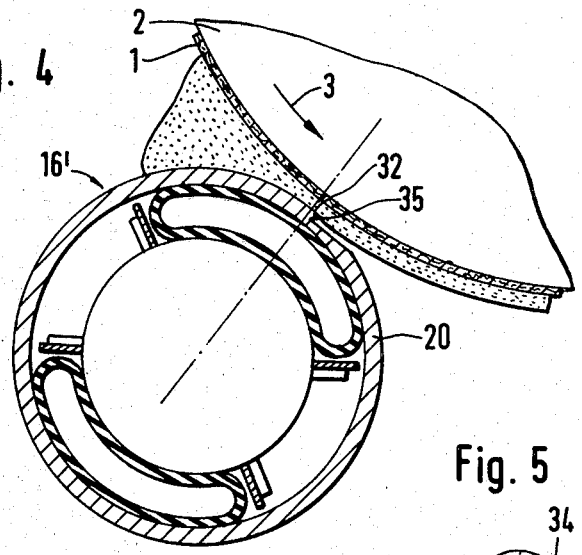
FIG. 4 is a cross-sectional view of another embodiment of a wiper for use in an improved apparatus constructed according to the present invention.
Figure 5:
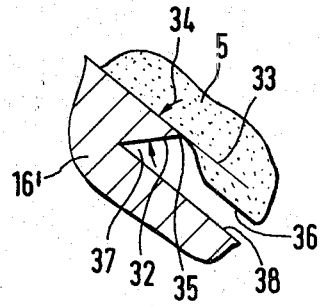
FIG. 5 is a partial, enlarged view of the wiper illustrated in FIG. 4 showing the break-away edge thereof.

The wiper 16' illustrated in FIGS. 4 and 5 corresponds substantially to that shown in FIG. 3, but has in tube 20 a milling cut 37 extending parallel to the axis of the tube which provides a break-away edge 35 behind the narrowest point between the circumference of cylinder 2 and the circumference of tube 20, as seen in the direction of rotation 3 of cylinder 2. The break-away edge is formed by the circumference of tube 20 and the re-entrant surface 32 which defines milling cut 37, and at the point of break-away edge 35 there is, thus, a step recessed inwardly at the outer circumference of the tube. This step is undercut, as can be seen in FIG. 5. The angle 34 between the tangential plane 33 at the outside circumference of wiper 16' and recessed surface 32 is less than 90°, i.e, an acute angle. In the illustrated embodiment of the invention, the angle 34 is approximately 60°. The break-away edge 35 causes foam layer 5 to suddenly increase behind the edge neatly to a somewhat larger thickness in the shape 36 without irregularities of the layer thickness occurring due to foam stuck to surface 32. The other contour surface 38 of recess 37 is spaced apart from foam layer 5, so that the latter is no longer contacted after it leaves edge 35.

Figure 6:
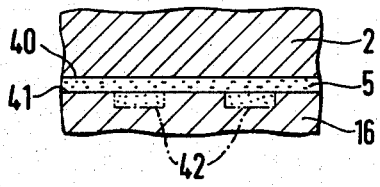
FIG. 6 is a cross-sectional view of the wiper illustrated in FIG. 3 in a direction perpendicular to the plane defined by the wiper and the axis of the rotating cylinder.

FIG. 6 shows in detail a cross-section of the wiper parallel to the adjustment plane at the narrowest point between cylinder 2 and wiper 16.

Two embodiments of the wiper 16 are illustrated. In the first embodiment, a straight generatrix 41 of wiper 16 is opposite the straight generatrix 40 of cylinder 2, or the correspondingly straight surface of web 1 at the narrowest point of gap 23. In this case, a constant thickness of foam layer 5 over the length of gap 23 is obtained, which makes uniform dyeing possible. However, generatrix 41 can also be shaped in the form of recesses or cutouts 42, which make foam layer 5 no longer flat but gives it a complementary profile which leads to a corresponding stripe pattern on web 1.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In an apparatus for the continuous treatment of webs of materials such as textile materials with a foamed treatment medium, said apparatus including a rotating cylinder the length of which is at least equal to the width of the web of material being treated and a portion of the surface of which engages the web of material, said web of material being looped over said cylinder in a looping region, said apparatus further comprising foam feeding means for transferring foam to the web of material in a transfer region located at the circumference of said cylinder, the improvement comprising said foam feeding means including a foam chamber disposed adjacent said cylinder at said looping region, said looping region being located on a side of said cylinder which descends during rotation of said cylinder, said chamber opening adjacent said web of material at said looping region, and wiper means disposed at the lower end of said foam chamber and extending parallel to the longitudinal axis of said cylinder, said wiper means comprising a wiper having an at least partially cylindrical cross section with a surface which is convex at least at said lower end of said foam chamber where said means extend parallel to the longitudinal axis of said cylinder, on the side facing said cylinder, and spaced from said web a preselected amount, whereby a desired layer height of foam will remain on said web after passing said wiper.

2. The improvement recited in claim 1, further comprising means for adjusting the radial distance of said wiper means from the outer surface of said cylinder.

3. The improvement recited in claim 2, further comprising means for adjusting the radial distance of said wiper means from the outer surface of said cylinder differently over the axial length of said wiper means.

4. The improvement recited in claim 3, wherein said wiper means includes means for controlling the deflection of said wiper means.

5. The improvement recited in claim 4, wherein said wiper means comprises a tube and a core extending longitudinally therethrough, the outer surface of said core being spaced apart from the inner surface of said tube, and a first chamber disposed in said tube between said core and the inner surface of said tube on a side of said tube adjacent said cylinder and extending substantially over the length of said tube, said first chamber having walls which are resilient in the direction of adjustment of the radial distance of said wiper means from the outer surface of said cylinder, said chamber being adapted to receive a fluid pressure medium.

6. The improvement recited in claim 5, further comprising a second chamber disposed within said tube between said core and the inner surface of said tube and disposed on a side of said tube opposite said first chamber, said second chamber having walls which are resilient in the direction of adjustment of the radial distance of said wiper means from the outer surface of said cylinder and extending substantially over the length of said tube, said second chamber being adapted to receive a fluid pressure medium.

7. The improvement recited in claim 6, wherein said first and second chambers each comprises a flexible tube closed at both ends thereof, said tube including means for filling said tube with said fluid pressure medium.

8. The improvement recited in claim 1 or 7, wherein said wiper means includes a recess disposed on a side thereof facing said cylinder and extending along the length of said wiper means, said recess including a surface portion of said wiper means which extends inwardly and opposite to the direction of rotation of said cylinder so as to form an edge at said recess.

9. The improvement recited in claim 8, wherein a tangential plane disposed at the outer circumference of said wiper means at said edge of said recess and said surface portion of said wiper means are disposed at an angle of less than 90° with respect to each other.

10. The improvement recited in claim 9, wherein said recess is formed so as to have a depth and shape which causes a layer of foam on said web of material formed at said edge of said wiper means to separate from said wiper means as said foam moves past said edge on said web.

11. The improvement recited in claim 1, wherein said foam chamber includes cover means extending over the width of said web of material and which covers the foam disposed in said chamber at least on a side thereof adjacent to said cylinder.

12. The improvement recited in claim 11, wherein said cover means is adapted to be moveable in a circular arc about the longitudinal axis of said cylinder.

13. The improvement recited in claim 12, wherein said cover includes an angled portion extending in the direction of rotation of said cylinder and located at an end of said cover adjacent to said cylinder.

* * * * *